US008025005B2

(12) United States Patent
Pavon

(10) Patent No.: US 8,025,005 B2
(45) **Date of Patent: *Sep. 27, 2011**

(54) SYSTEM AND METHOD FOR PROTECTING VEHICLE OCCUPANTS

(76) Inventor: John J. Pavon, College Point, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/862,899

(22) Filed: Aug. 25, 2010

(65) Prior Publication Data

US 2010/0319525 A1 Dec. 23, 2010

Related U.S. Application Data

(63) Continuation of application No. 11/825,273, filed on Jul. 5, 2007, now Pat. No. 7,908,959.

(51) Int. Cl.
*F41H 5/007* (2006.01)
*B62D 25/20* (2006.01)

(52) U.S. Cl. ..... 89/36.17; 89/902; 89/917; 296/187.07; 296/193.07

(58) Field of Classification Search ..... 89/36.02, 89/36.08, 36.09, 36.17; 296/187.07, 193.07
See application file for complete search history.

(56) References Cited

U.S. PATENT DOCUMENTS

| | | | | |
|---|---|---|---|---|
| 4,326,445 | A | 4/1982 | Bemiss | |
| 4,833,967 | A * | 5/1989 | Kornhauser | 89/34 |
| 4,869,152 | A | 9/1989 | Marlow | |
| 4,965,138 | A * | 10/1990 | Gonzalez | 428/593 |
| 5,663,520 | A | 9/1997 | Ladika | |
| 5,804,757 | A * | 9/1998 | Wynne | 89/36.05 |
| 6,345,563 | B1 | 2/2002 | Middione et al. | |
| 6,658,984 | B2 | 12/2003 | Zonak | |
| 7,114,764 | B1 | 10/2006 | Barsoum et al. | |
| 2003/0010189 | A1 | 1/2003 | Zonak | |
| 2006/0048641 | A1 | 3/2006 | Gonzalez | |
| 2006/0086243 | A1 | 4/2006 | Seo et al. | |
| 2006/0201319 | A1 | 9/2006 | DeWet | |
| 2007/0017361 | A1 | 1/2007 | Zank et al. | |

* cited by examiner

*Primary Examiner* — Bret Hayes
(74) *Attorney, Agent, or Firm* — Triangle Patents

(57) ABSTRACT

The present invention is directed to an armor system that protects vehicle occupants from lands mines or improvised explosive devices. In the preferred embodiment, the armor system has an arc member, a membrane, reactive blocks, and a reactive block enclosure. The armor system is designed to dissipate, neutralize, and redirect explosion energy, fragments and shrapnel, thereby ensuring the safety of the vehicle occupants.

17 Claims, 10 Drawing Sheets

SYSTEM AND METHOD FOR PROTECTING VEHICLE OCCUPANTS

CROSS-REFERENCE TO RELATED APPLICATIONS

This application claims the benefit of prior-filed U.S. patent application Ser. No. 11/825,273 filed Jul. 5, 2007 now U.S. Pat. No. 7,908,959 and is a continuation of that application, which is incorporated herein by reference in its entirety, including the figures and corresponding description.

BACKGROUND OF THE INVENTION

1. Field of the Invention

The present invention relates generally to vehicle armor for protection from explosive devices. Further, the present invention relates to an armor system that protects vehicle occupants from land mines and improvised explosive devices.

2. Description of the Prior Art

Typically, vehicle armor is used on military motor vehicles, such as a High Mobility Multipurpose Wheeled Vehicle (HMMWV or Humvee). The U.S. Department of Defense defines three levels of protection for Humvees. Level-one protection describes a Humvee that comes directly from its manufacturing facility "up-armored" with bullet-proof glass and armor on the sides, front, rear, top, and bottom. Level-two protection is achieved by "add-on" armor kits that are fitted to existing Humvees that were originally unarmored or "soft-skinned." However, these kits only provide front, rear, side, and glass protection, while leaving the top and the bottom of the vehicle vulnerable. Level-three armor refers to the use of steel plates that are welded or bolted onto an unarmored Humvee and provides the least amount of protection to its occupants. Even when equipped with level-one protection, however, most up-armored Humvees offer little protection against blasts from below and only sufficiently protect against lateral attacks.

Originally designed for personnel and light cargo transport, the basic Humvee has no armor or protection. To provide a defense against ballistic weapons and more specifically, land mines and improvised explosive devices, prior art devices commonly use various armor designs (see, e.g., U.S. Pat. No. 6,658,984; U.S. Published Patent Application No. 2003/0010189; U.S. Published Patent Application No. 2006/0201319; U.S. Pat. No. 5,663,520; U.S. Pat. No. 4,326,445; U.S. Pat. No. 7,114,764; U.S. Published Patent Application No. 2006/0048641) and reactive elements (see, e.g., U.S. Published Patent Application No. 2007/0017361; U.S. Pat. No. 6,345,563; U.S. Published Patent Application No. 2006/0086243) to achieve the aforementioned levels of protection.

For example, U.S. Pat. No. 6,658,984 and U.S. Published Patent Application No. 2003/0010189 describe an apparatus for providing anti-mine protection for an armored vehicle comprising a concave floor plate mounted to the outer hull of a vehicle. Similarly, U.S. Patent Application No. 2006/0201319 describes a "convex-shaped" protection apparatus attached underneath a vehicle that is capable of resisting a force applied to it. These documents, however, describe protection systems that only use a form of hard armor. They do not use any kind of reactive devices or deformable membranes to further protect vehicle occupants.

On the other hand, U.S. Patent Application No. 2007/0017361 describes an active armor system having two layers, where if the outer layer is attacked by projectile, one or more shaped charges are detonated in the opposite direction to degrade the effectiveness of the projectile. This system can be used on a lightly armored vehicle or retrofitted onto an unarmored vehicle. Likewise, U.S. Pat. No. 6,345,563 describes a reactive armor system that contains armor plates with wells. Within each well, several holes hide explosive pills. When one pill is detonated by a projectile, several pills around it are also detonated by means of an explosive sheet. This armor system can be used for the bottom of a tank for protection against armor-piercing land mines. However, while these protection systems use reactive elements and outer shields, they do not use an additional deformable membrane layer in between the two components.

Though all of these devices use armor, reactive explosive devices, or a combination of both, none of the aforementioned documents combine armor, a deformable membrane, and reactive blocks to protect the vehicle's occupants from land mines or improvised explosive devices. To minimize the danger to a vehicle's occupants, the protection system should not only provide an armor shield and reactive elements, but it should utilize a deformable membrane in between the armor and reactive elements to trap residual explosive elements.

Thus, there remains a need for a vehicle armor system that adequately protects occupants from land mines and improvised explosive devices.

SUMMARY OF THE INVENTION

A first aspect of the present invention is to provide an apparatus for use in a protective system for shielding vehicle occupants from explosive devices including an arc member having a contoured surface; a membrane juxtapositioned below the arc member contoured surface; reactive blocks constructed and configured outside the membrane away from the arc member; and an enclosure for covering the reactive blocks; wherein the apparatus is attachable to a vehicle surface for providing a protective system for shielding and deflecting an explosive force away from the arc member to protect passengers in a vehicle.

A second aspect of the present invention is to provide protective system for shielding vehicle occupants from explosive forces outside the vehicle including a vehicle having an underside surface to which is mounted an apparatus having an arc member having a contoured surface; a membrane juxtapositioned below the arc member contoured surface; reactive blocks constructed and configured outside the membrane away from the arc member; and an enclosure for covering the reactive blocks; wherein the arc member is attached with the contoured surface facing downwardly; thereby providing a protective system for shielding and deflecting an explosive force away from the arc member to protect passengers in a vehicle.

The present invention is further directed to a method for protecting vehicle occupants from external explosive forces and materials, in particular where positioned on or under the ground such that a vehicle passing overtop of it would be exposed to the force upwardly, the method including the steps of providing an apparatus attached to a vehicle underside to provide the protective system having an arc member having a contoured surface; a membrane juxtapositioned below the arc member contoured surface; reactive blocks constructed and configured outside the membrane away from the arc member; and an enclosure for covering the reactive blocks; wherein the system functions to actively and passively shield the vehicle occupants from the external explosive force below the vehicle.

Thus, the present invention provides complete underside protection for vehicle passengers to ensure that any explosive force is both passively and actively shielded and redirected, respectively, away from the vehicle passengers.

These and other aspects of the present invention will become apparent to those skilled in the art after a reading of the following description of the preferred embodiment when considered with the drawings, as they support the claimed invention.

DETAILED DESCRIPTION

Figure 1:
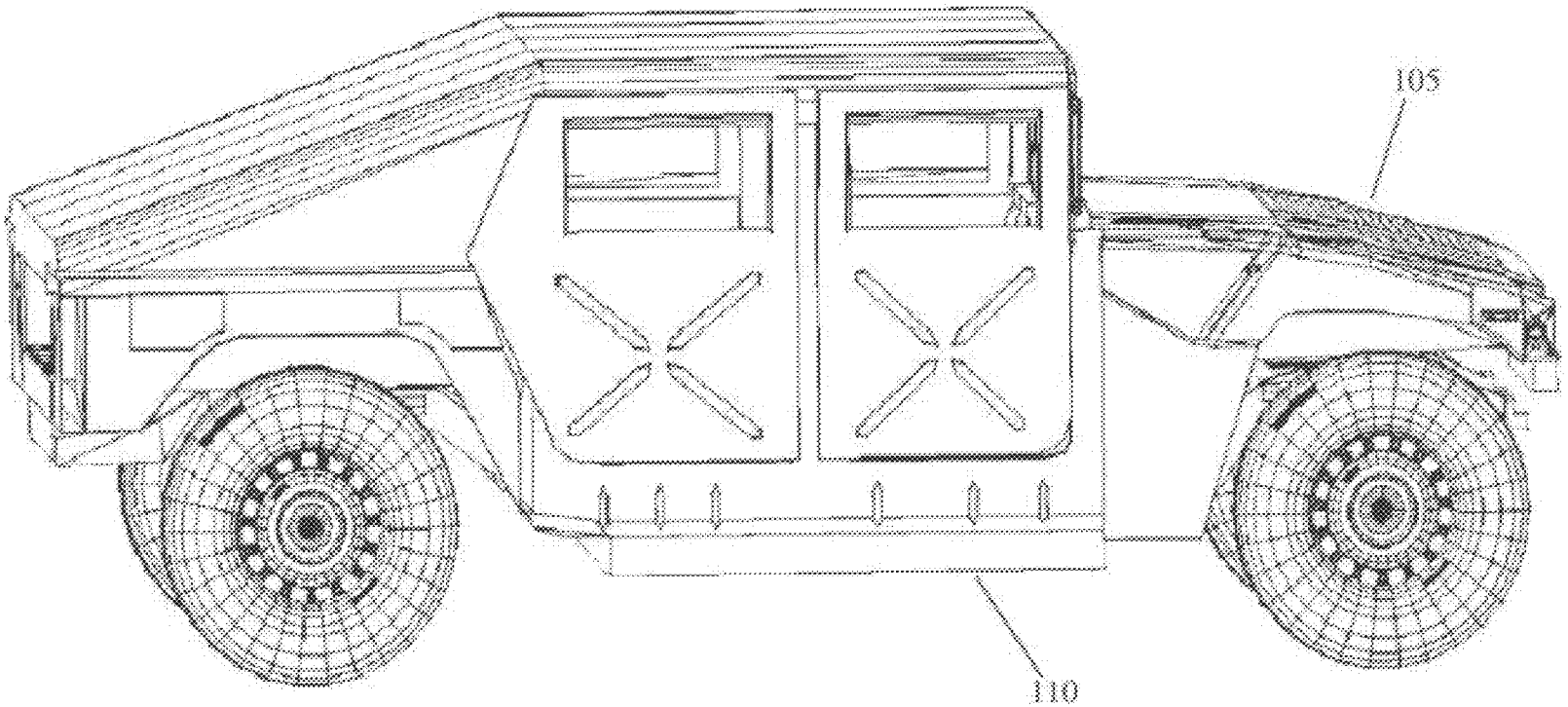
FIG. 1 is a perspective view of the armor system including the protective apparatus attached to a vehicle according to an embodiment of the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

The present invention provides an apparatus for use in a protective system for shielding vehicle occupants from explosive devices including an arc member having a contoured surface; a membrane juxtapositioned below the arc member contoured surface; reactive blocks constructed and configured outside the membrane away from the arc member; and an enclosure for covering the reactive blocks; wherein the apparatus is attachable to a vehicle surface for providing a protective system for shielding and deflecting an explosive force away from the arc member to protect passengers in a vehicle.

Also, the present invention provides a complete protective system for shielding vehicle occupants from explosive forces outside the vehicle including a vehicle having an underside surface to which is mounted an apparatus having an arc member having a contoured surface; a membrane juxtapositioned below the arc member contoured surface; reactive blocks constructed and configured outside the membrane away from the arc member; and an enclosure for covering the reactive blocks; wherein the arc member is attached with the contoured surface facing downwardly; thereby providing a protective system for shielding and deflecting an explosive force away from the arc member to protect passengers in a vehicle.

Methods for protecting vehicle occupants from external explosive forces and materials, in particular where positioned on or under the ground such that a vehicle passing overtop of it would be exposed to the force upwardly, the methods including the steps of providing an apparatus attached to a vehicle underside to provide the protective system having an arc member having a contoured surface; a membrane juxtapositioned below the arc member contoured surface; reactive blocks constructed and configured outside the membrane away from the arc member; and an enclosure for covering the reactive blocks; wherein the system functions to actively and passively shield the vehicle occupants from the external explosive force below the vehicle, including automatically activating the reactive blocks when an external explosive force occurs underneath the vehicle surface, whether the vehicle is moving or stopped.

Referring now to the drawings in general, the illustrations are for the purpose of describing a preferred embodiment of the invention and are not intended to limit the invention thereto. As best seen in FIG. 1, an armor system 110 constructed according to the present invention is shown from a perspective view, the system being attached to a vehicle 105 for protecting vehicle occupants from an explosive device beneath the vehicle by passively and actively shielding, deflecting and redirecting the explosion away from those occupants; the system is also shown from a cross-sectional view, detached from or not connected to a vehicle in FIG. 2.

The armor system 110 in FIG. 1 is mounted directly underneath the occupants of a vehicle 105; in a preferred embodiment provided by way of example and to provide corresponding dimensions to illustrate the present invention but not limit it thereto, the system is shown mounted to a vehicle, in particular to a Humvee. The armor system of the present intention may be adapted to other vehicles, including transport trucks and VIP vehicles; in these alternative embodiments, the armor system would need to be scaled accordingly. The location, construction and configuration of the armor system predominately preserves the safety of the occupants with little concern about the ultimate condition of the vehicle after an explosion, i.e., the protective system does not provide shielding for overall vehicle body itself. Preferably the armor system is bonded, mechanically fastened, welded, or placed on rails to mount to the bottom of the vehicle. If the system is releasably attached to the vehicle, then it may also be removed and used in defense of people outside the vehicle against, for instance, small arms or rocket attack.

Figure 2:
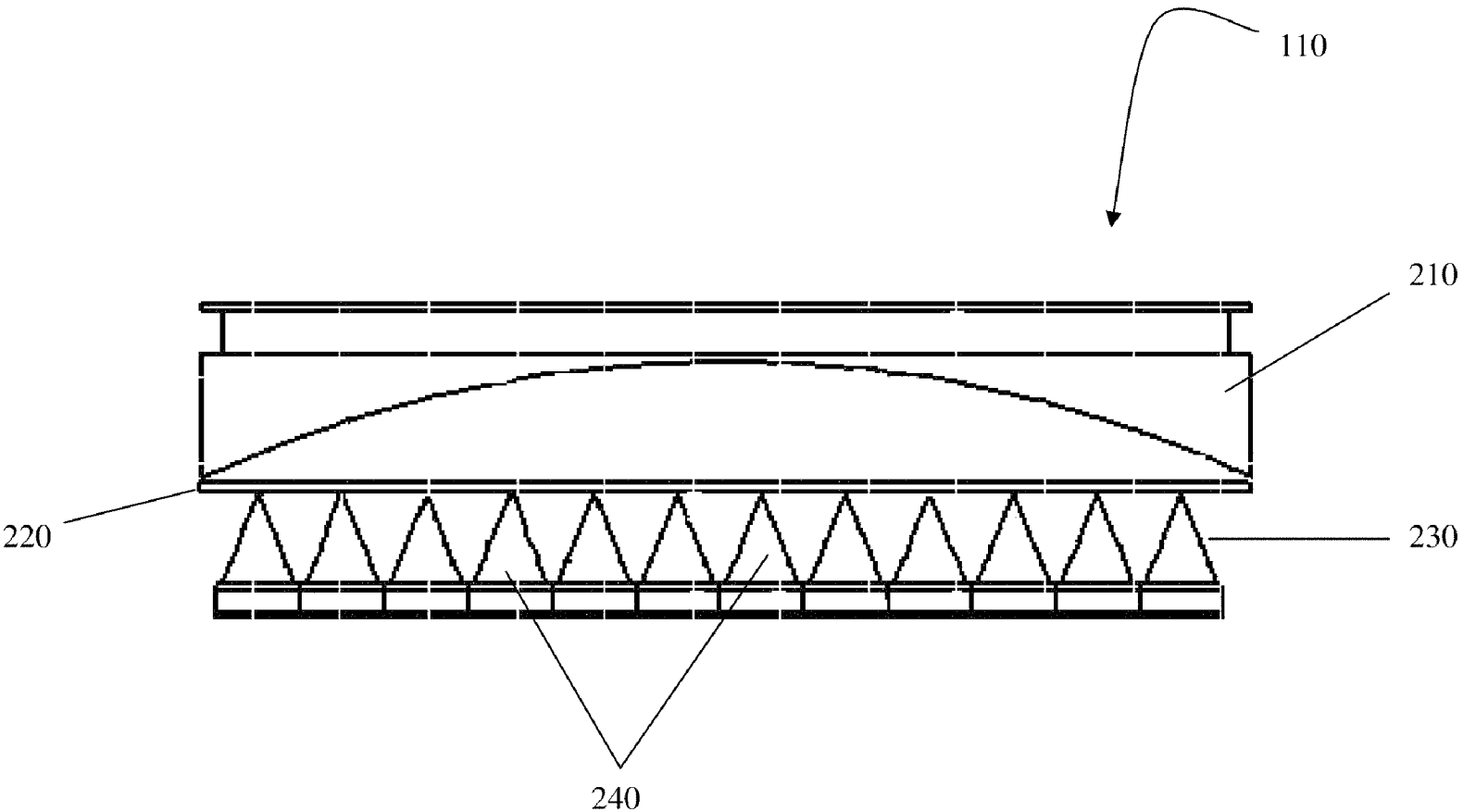
FIG. 2 is a cross-sectional view of the protective apparatus according to one embodiment of the present invention.

Key components of the protective system according to the present invention include an arc member, a membrane, reactive blocks, and an enclosure for covering the reactive blocks, all constructed and configured in appropriate relation for providing a protective system for shielding and deflecting an explosive force to protect passengers in a vehicle. This listing order defines their preferred order and configuration, listed from the mounting surface underneath a vehicle outwardly, respectively. As illustrated in FIG. 2 by way of example, an arc member 210 is the base or foundational component of the armor system 110 that is mounted to the underside of a vehicle 105 (attachment illustrated in FIG. 1); the total apparatus height is between about 12 and about 15 inches, preferably about 13 inches as shown in the figures. Preferably, the arc member is mounted directly to the underside of the vehicle and positioned continuously and completely underneath the driver and passenger seating area, with the arc member having an arc or contoured surface that presents a substantially concave surface facing downwardly away from the vehicle (toward the ground or driving surface). In alternatively embodiments, additional coverage for rearward passengers and/or cargo is provided, with the arc member being constructed and configured to shield and deflect explosive forces downwardly away from the passenger seating area directly above the arc member. Approximately 16 of clearance exists between the bottom of the example vehicle, a Humvee, and the ground, as illustrated in the figures. This clearance distance or space provides room for the other key components of the system, namely the membrane, reactive blocks, and the enclosure, all of which are mounted to the arc member. The arc member 210 is preferably attached to the underside of a vehicle 105 in FIG. 1 by any suitable means to provide secure attachment, such as welding, bolting, bolted clamps, a track and slide mechanism, clamps, adhesive, and combinations thereof; more preferably, the arc member is retrofittable to any existing vehicle, and correspondingly the attachment is selected accordingly. The arc member is also concave and faces downward to contain the explosion and diverge fragments and shrapnel, where fragments are missiles that may be torn from an explosion and shrapnel are preformed pieces of metal placed in or around an explosive. Furthermore, the arc member has no joints or seams; instead, it is a continuous surface and has a unitary, integral construction in order to preserve its continuous nature and to ensure maximum shielding and deflection from an external explosive force.

The arc has an inner length, measuring from endpoint to endpoint, that is approximately about one inch shorter than the length of the vehicle's occupant compartment. An outer length is approximately the same length as the vehicle's occupant compartment. In the case of the Humvee example, the arc has an inner length that is about 47 inches, and an outer length that is about 48 inches. Similarly, the width of the arc is substantially approximately the same width as the vehicle to which it is attached to ensure maximum shielding effect of the overall system. As shown in the figures and attached to a Humvee, the arc member is about 86 inches in width, which is approximately the distance to fully shield the driver and adjacent passenger spaces for that example vehicle; relative height being about 13 inches The radius of the arc depends on the full length or distance of the vehicle intended to be protected with the apparatus of the present invention, and the ground clearance of the vehicle. The radius of the arc when attached to a Humvee is between about 50 and about 60 inches, more preferably between about 54 and about 56 inches, and still more preferably about 56.039 inches.

Preferably, the arc member is formed from a hard ceramic material. Boron carbide, the fifth hardest material on the Mohs scale and characterized by its chemical resistance, nuclear properties, and low density, is one possible compound to consider when manufacturing the arc. Other possible arc materials include composites and ceramic composites. Other materials that can be used for forming the arc member include alumina, silicone carbide, titanium boride, and aluminium nitride.

Constructed and configured below the arc member 210 as illustrated in FIG. 2 is a deformable membrane 220 that envelops explosion elements such as fragments and shrapnel. The membrane is positioned on top of the reactive block enclosure 230. This location is also above the apexes of the top layer of pyramids in reactive blocks 240. Consequently, an empty space exits between the arc 210 and the membrane 220.

In one embodiment of the present invention, the membrane is optionally combined with the enclosure where both the membrane and the enclosure are made of the same material. By way of example and not limitation, a Lexan box formed with the reactive blocks disposed therein, with the box surrounded by the enclosure.

The membrane is formed from polycarbonate resin thermoplastic (one such preferably material is sold as LEXAN®) or another type of viscoelastic material with similar functionality and characteristics. Preferably the membrane is formed from a highly durable polycarbonate resin thermoplastic material of the type that is most notably used in canopies of fighter aircraft, water bottles, etc.

Figure 3:
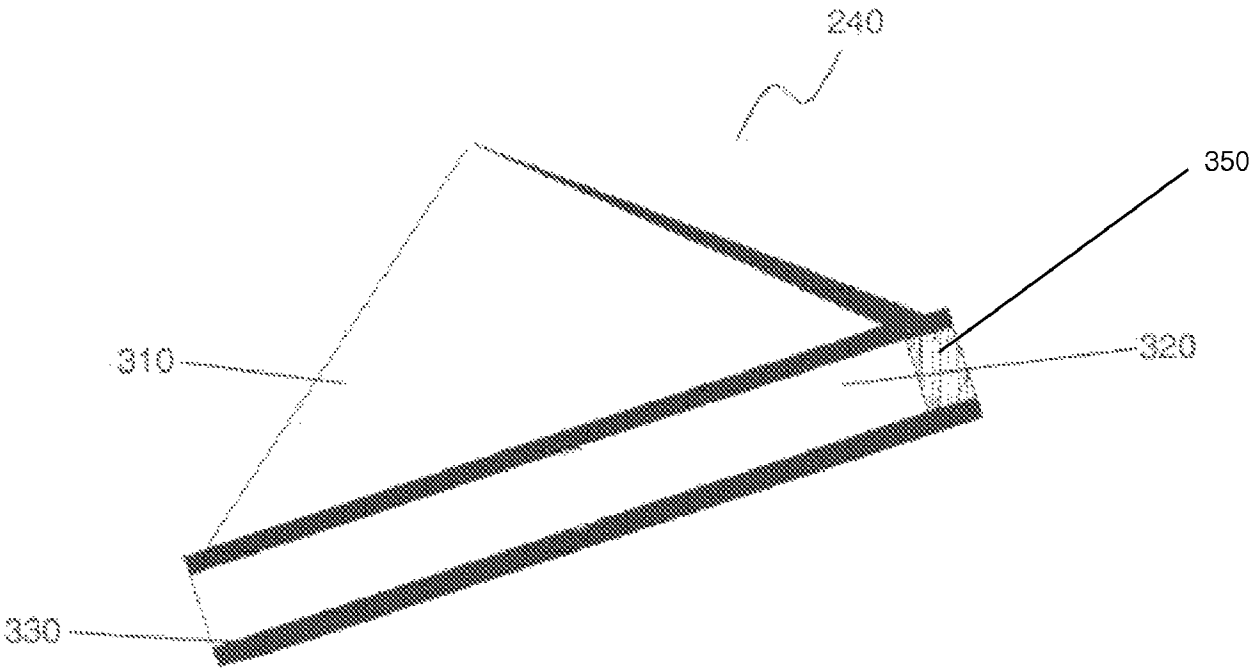
FIG. 3 is a perspective view of the assembled reactive block according to one embodiment of the present invention.

Positioned underneath the membrane 220 are reactive blocks 240 (shown in the various FIGS. 2, 3, and 4), which function to neutralize external explosive forces, such as those from a single 155 mm shell explosive or 155 mm shell explosives "daisy chained" together. A single reactive block 240 further comprises pyramids 310, 320, and 330 in FIGS. 3 and 4. The three pyramids are stacked upon each other as shown in FIG. 3. A multiplicity of the single reactive blocks are provided in spaced apart distributed relation across a space that substantially matches the dimensions of the arc member foundation (length and width).

Figure 4:
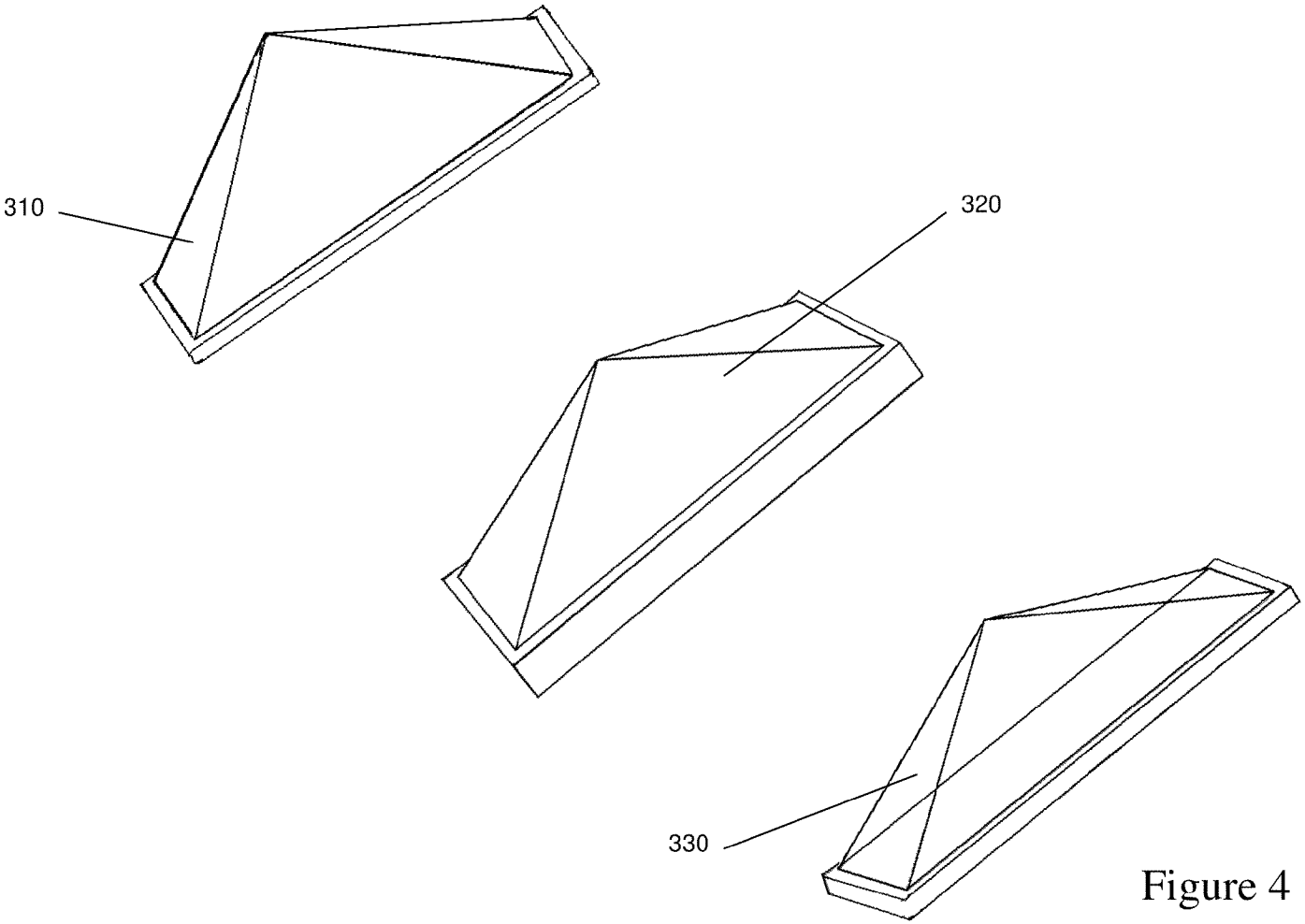
FIG. 4 is an exploded perspective view of the reactive block shown in FIG. 3.

Pyramids 310 and 330 in FIGS. 3 and 4 are made of ATI 425 titanium, a high-strength alloy known for its hot and cold workability. Pyramid 320 is made of an explosive material, such as PBX, RDX, or HMX (Octogen) compositions, or the like. Preferably, it is a PBX (plastic-bonded explosive) having RDX (Cyclotrimethylenetrinitramine) and plasticizers as a component, which results in an extremely light chemical composition. The reaction that produces this explosion is triggered by a shockwave from a land mine or improvised explosive device. A shockwave is a high-pressure wave that moves through a material at a faster speed than the speed of sound within that material. Thus, small arms fire or the equivalent would not detonate the reactive explosion of pyramid 320 since it does not produce a shockwave. Small arms fire would simply melt a small amount of explosive in the pyramid 320, slowly oxidizing it at a sub-sonic level and not the super-sonic level needed for detonation.

The term burn and detonate are very commonly used but many people don't really know the mechanics involved when using the terminology. When a material burns the oxidation takes place slowly at a sub-sonic level. Detonation however, burns the material at a supersonic rate. This is why small arms fire won't trigger the device.

The previously mentioned reactive blocks 240 are housed in an enclosure 230 in FIG. 2. In a preferred embodiment, it holds an array of about 8 reactive blocks by about 12 reactive blocks. In such an embodiment, the enclosure is box-shaped and mounted to the bottom of the arc member 210. It covers the opening of the arc member 210 to form a covering or lid under the membrane 220. However, the enclosure is releasably attached to the arc member such that it is operable to move during an explosion to further dissipate the explosion's energy. The enclosure is preferably made of Lexan, titanium, aluminum, or composite materials. The enclosure can be mechanically fastened or bonded to the arc member.

Preferably, the apparatus is retrofittable to existing vehicles for providing the hybrid protecting that is both active and passive, provided by the components of the apparatus set forth hereinabove. When installed or mounted to a vehicle, the present invention functions to automatically activate the active protection when an external explosive force occurs underneath the vehicle, either stopped or moving. When moving, as the motor vehicle 105 illustrated in FIG. 1 passes over a land mine or improvised explosive device that is ground-based or positioned on the ground, the explosive typically detonates once the pressure applied from above it, such as by a vehicle's tire, is relieved. The explosive then sends energy in the form of a shockwave and heat upward and into the underside of a vehicle 105. Elements of the explosion first come into contact with the armor system 110 in FIGS. 1 and 2 via the first layer of pyramids 330 in FIGS. 3 and 4, which reside in the reactive block enclosure 230 in FIG. 2. This layer of pyramids that forms the reactive blocks then directs the explosion energy into the pyramid apexes. The pressure from this energy automatically triggers a smart sensor 350 and detonates the second layer of pyramids 320 in FIGS. 3 and 4. This reaction creates another explosion that functions to neutralize and counteract the initial shockwave of the land mine or improvised explosive device explosion. The third layer of pyramids 310 then further redirects the remaining energy of the initial explosion into its apexes. By this point, the majority of the initial explosion's energy is substantially defused.

However, fragments and shrapnel from the initial explosion and fragments caused by the reactive explosion of the second layer of pyramids 320 may still be a threat to occupants of a vehicle 105 in FIG. 1. Thus, the present invention functions to ensure that fragments and the third layer of pyramids are degraded and trapped in the membrane 220 in FIG. 2 that lies above the apexes of the top layer of pyramids 310, illustrated in FIGS. 3 and 4. Furthermore, if any remaining fragments and shrapnel continue to travel upward past the membrane 220 in FIG. 2, the arc 210 is constructed and configured to provide an additional and possibly last line of defense for the vehicle occupants from an explosion; the arc functions to completely block these fragments from entering the occupant compartment of a vehicle 105 in FIG. 1, thereby shielding the occupants completely from any fragments that have not already been handled by the system of the present invention. Consequently, the vehicle may be damaged or rendered inoperable after a land mine or improvised explosive device explosion, but the vehicle occupants are shielded and safe from harm by the underside or land-based explosive device.

Figure 5:
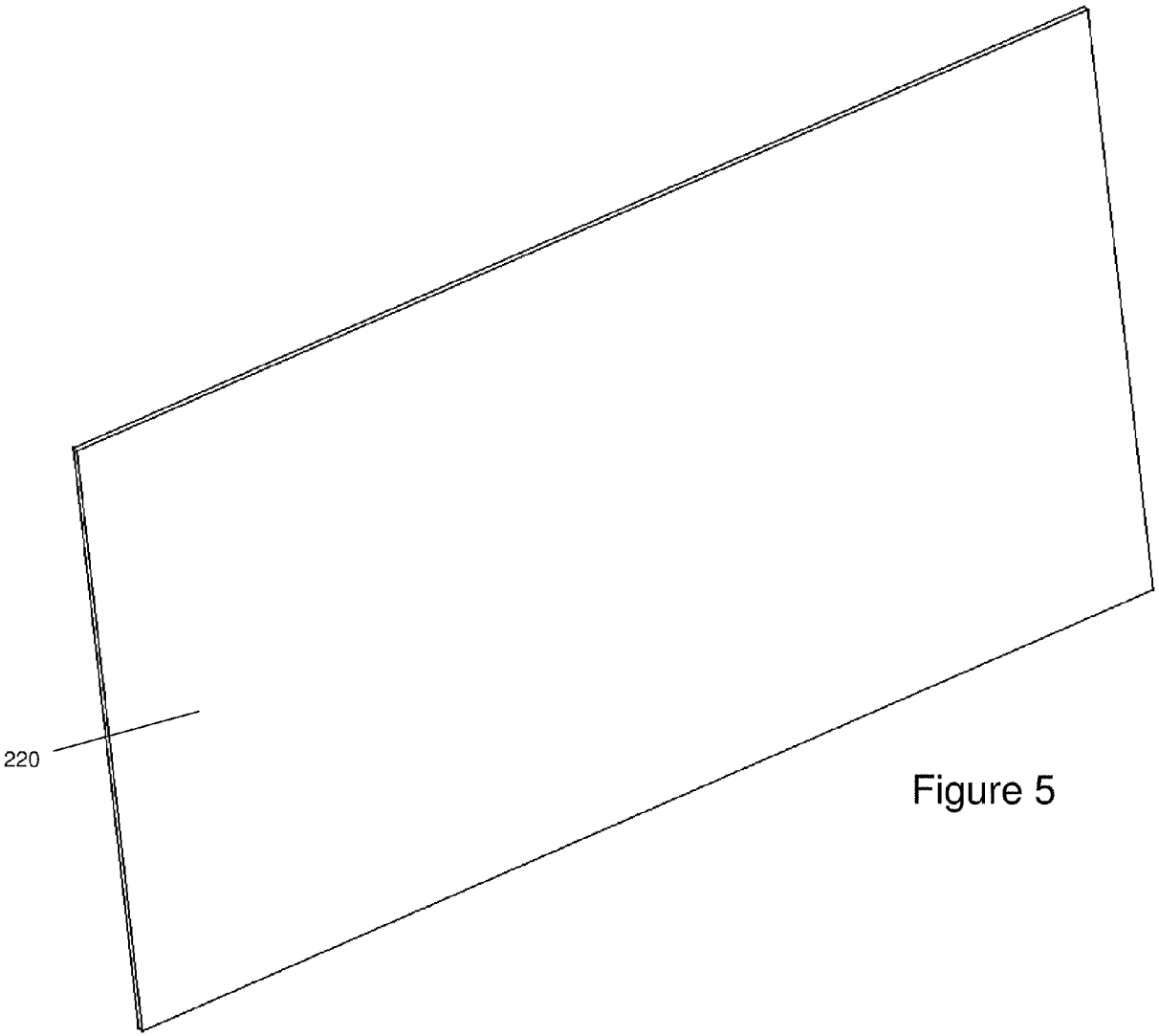
FIG. 5 is a perspective view of the membrane according to one embodiment of the present invention.
Figure 6:
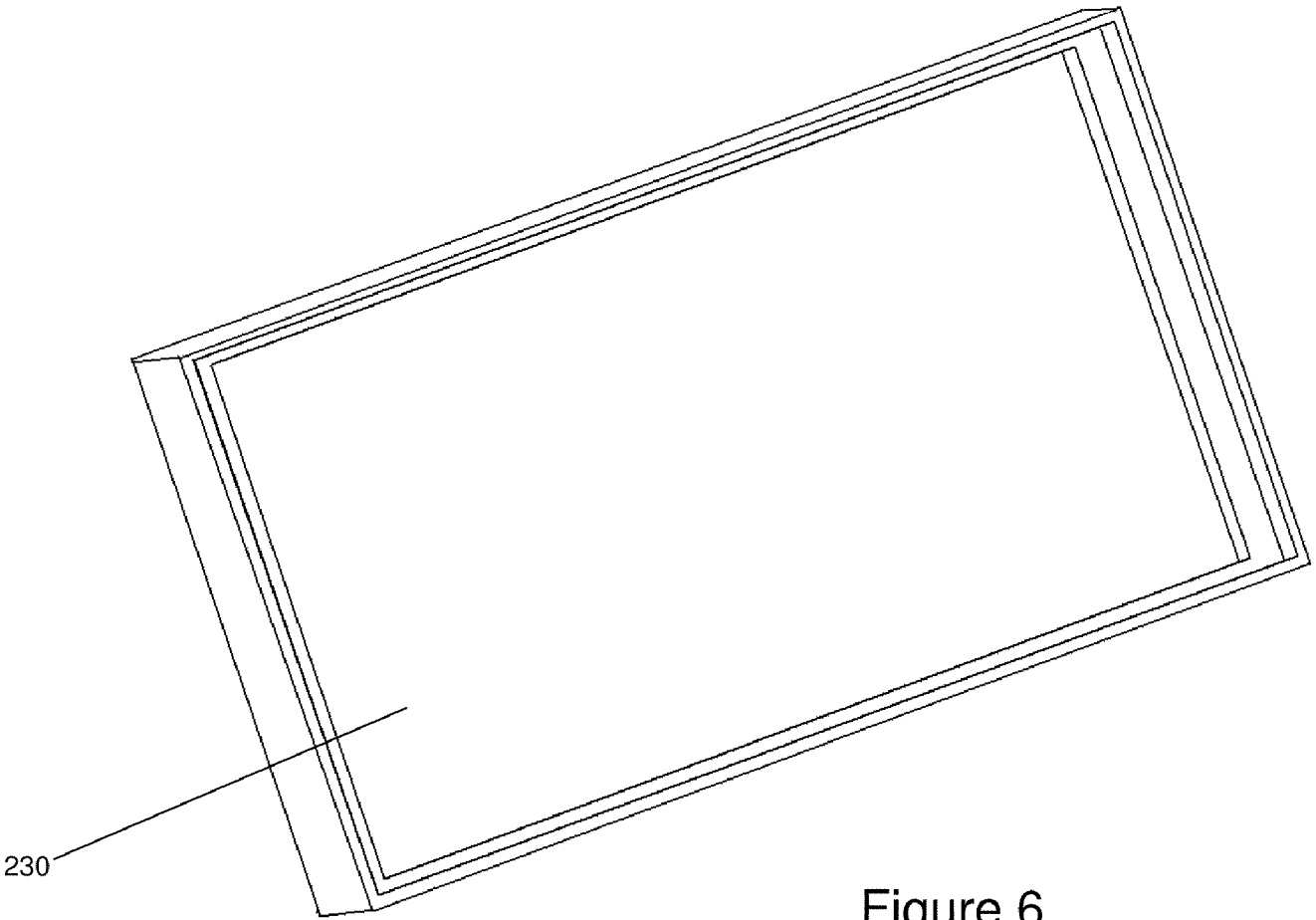
FIG. 6 is a perspective view of the enclosure according to one embodiment of the present invention.
Figure 7:
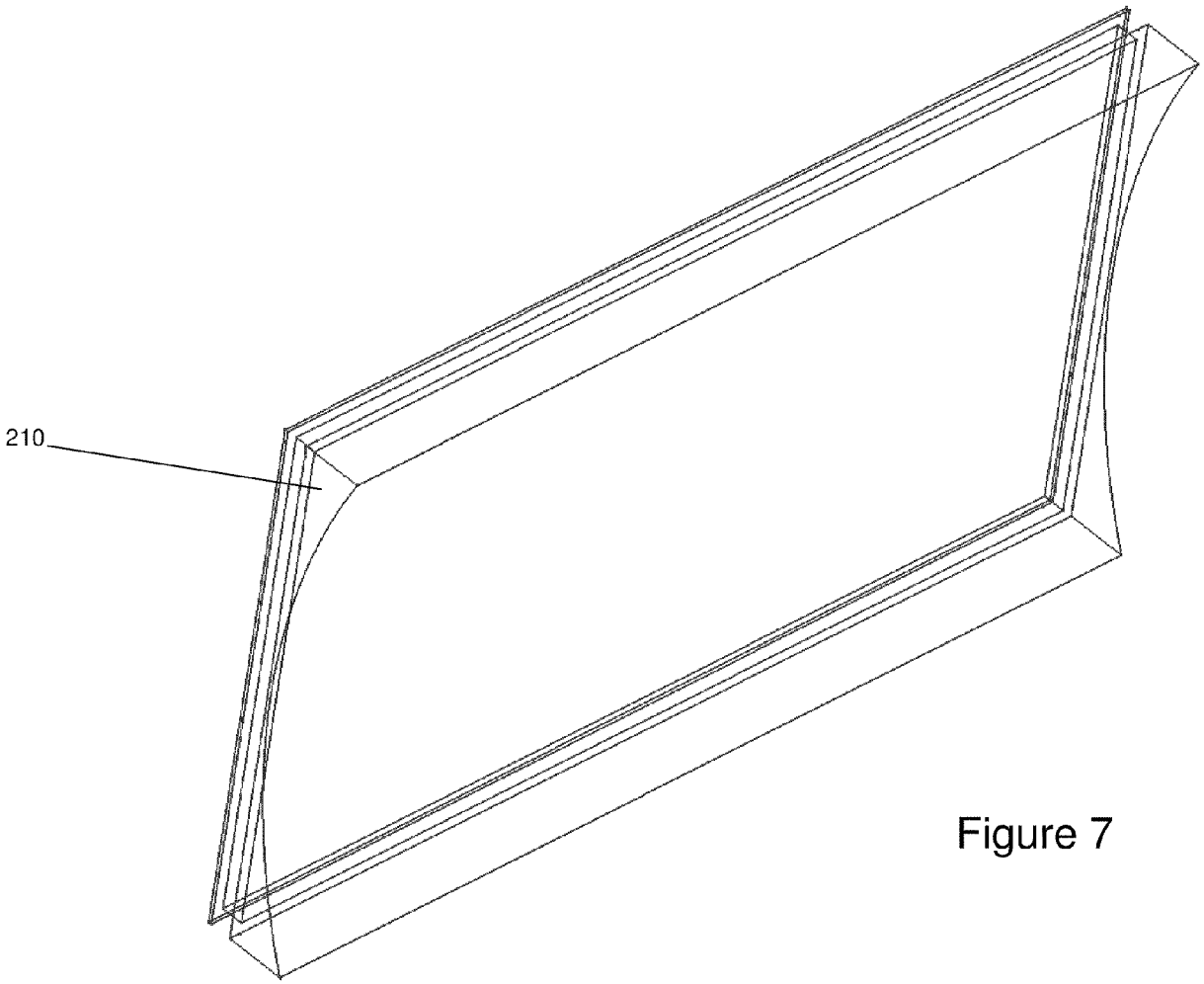
FIG. 7 is a perspective view of the arc member according to one embodiment of the present invention.

According to one embodiment of the present invention, some of individual components of the present invention are individually shown in FIGS. 5-7. FIG. 5 is a perspective view of the membrane 220. FIG. 6 is a perspective view of the enclosure 230. And, FIG. 7 is a perspective view of the arc member 210.

Figure 8:
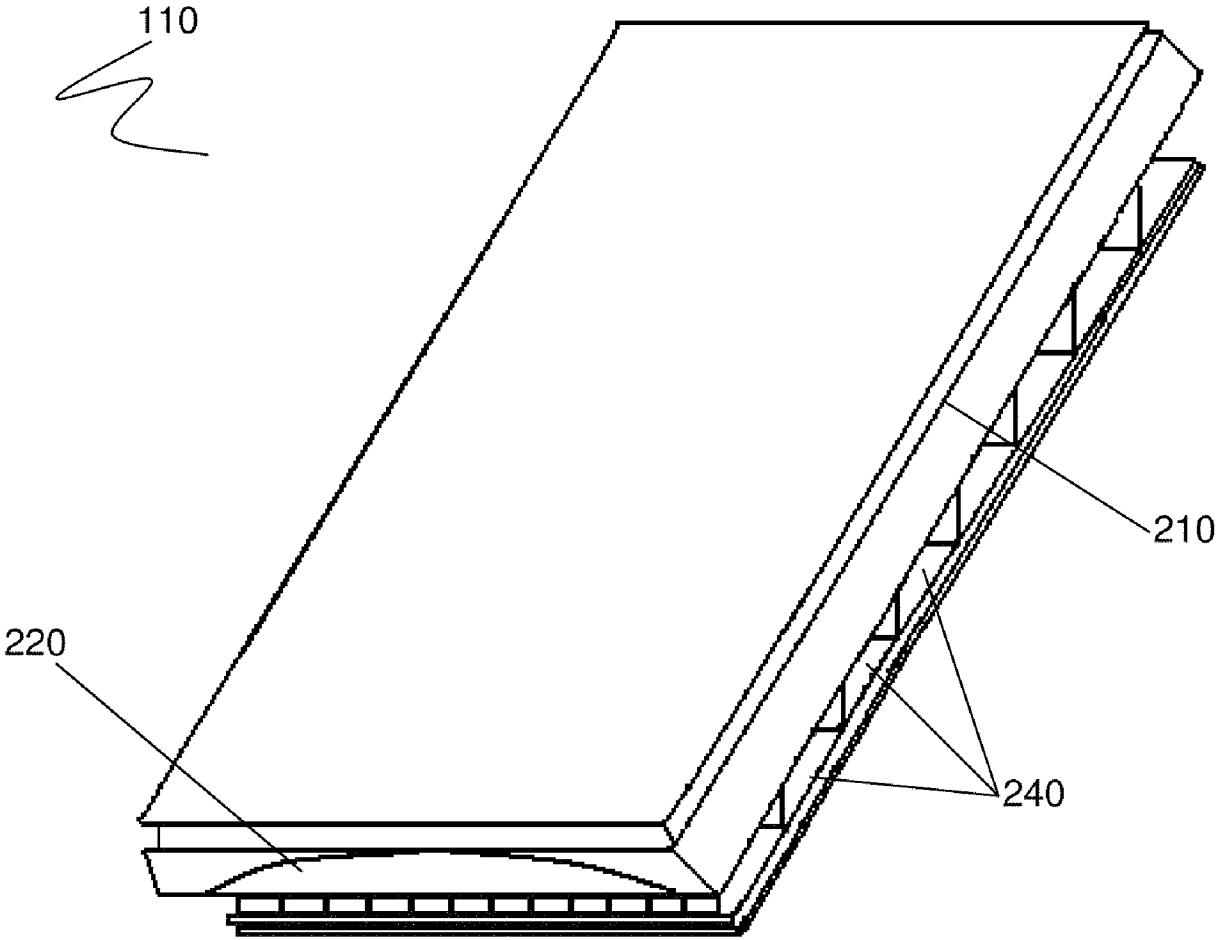
FIG. 8 is a perspective view of the protective apparatus shown in FIG. 2.

FIG. 8 is a perspective view of the protective apparatus 110 shown in FIG. 2. Reactive blocks 240 are contained within the enclosure (not shown) and positioned below the membrane 220 and subsequently below arc member 210.

Figure 9:
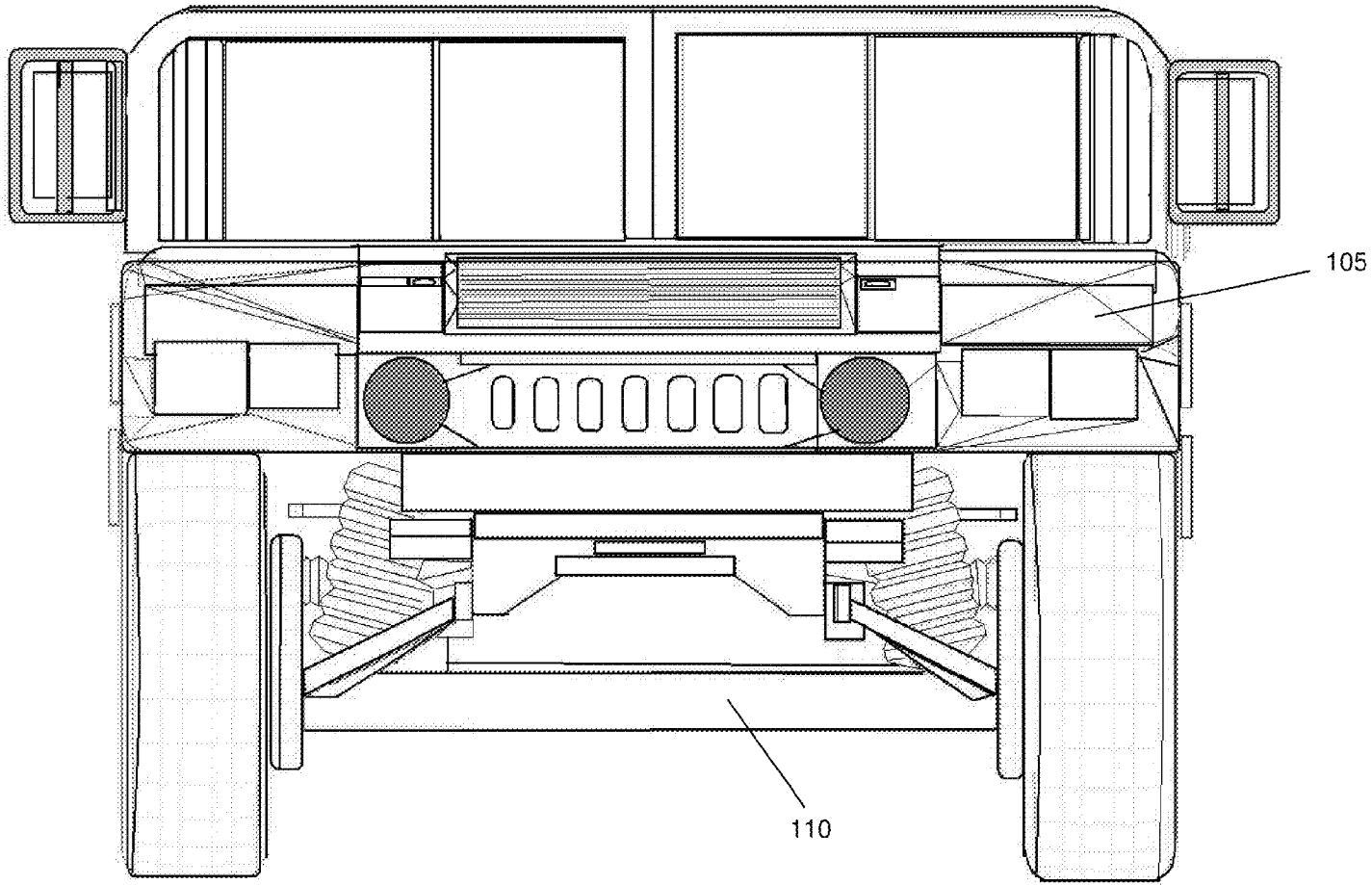
FIG. 9 is a front view of the armor system including the protective apparatus attached to a vehicle shown in FIG. 1.
Figure 10:
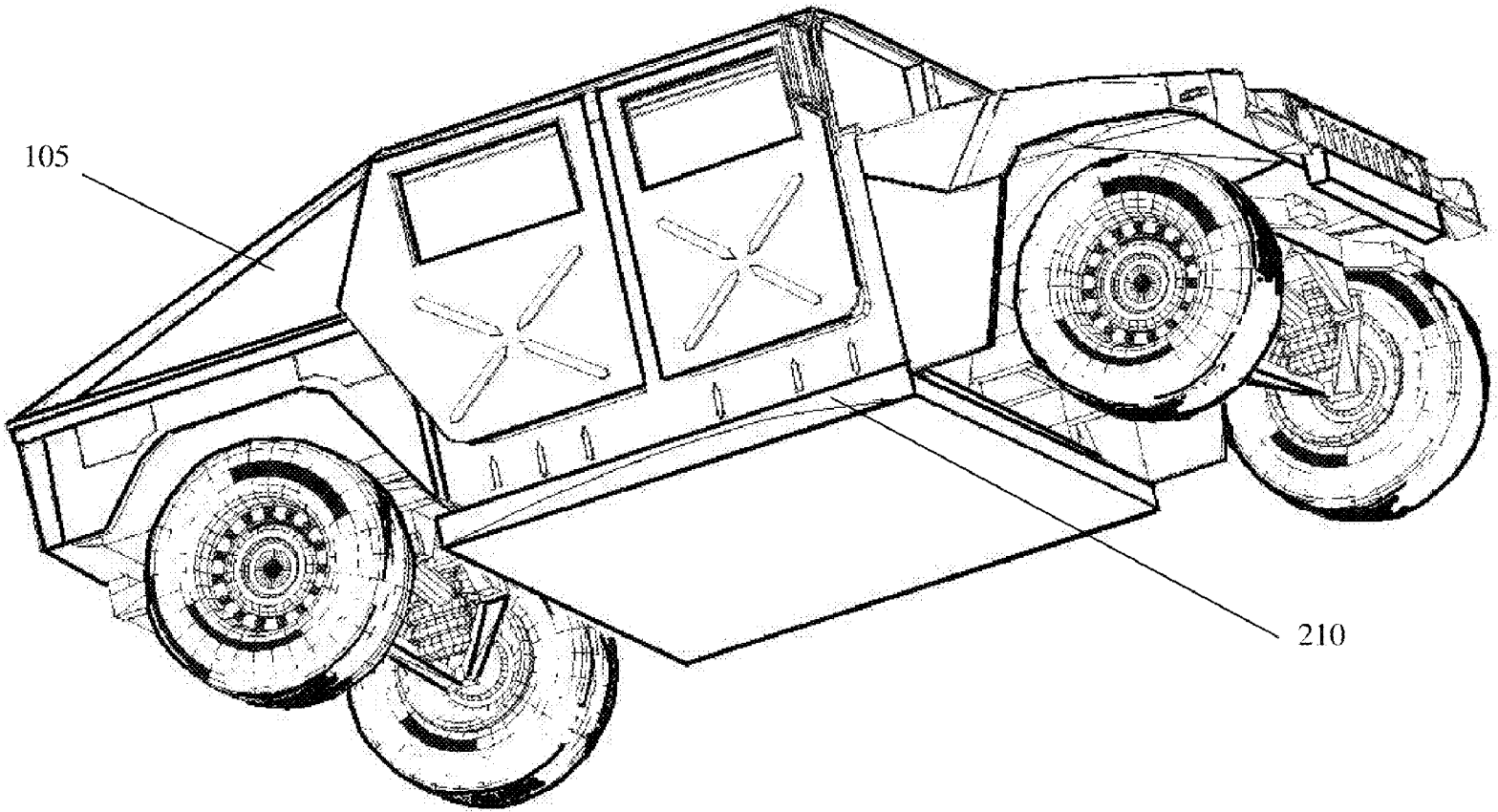
FIG. 10 is a front view of the arc member attached to a vehicle according to one embodiment of the present invention.

FIGS. 9 and 10 illustrate the mounting and orientation of one embodiment of the present invention. FIG. 9 is a front view of the armor system 110 including the protective apparatus attached to a vehicle 105 shown in FIG. 1. FIG. 10 is a front view of the arc member 210 attached to a vehicle 105 according to one embodiment of the present invention. This illustrates the orientation of the armor system with respect to the vehicle according to one embodiment of the present invention.

Certain modifications and improvements will occur to those skilled in the art upon a reading of the foregoing description. By way of example, protective skirts can be added to the sides of the armor system to protect bystanders near the vehicle from discharged elements should an explosive detonate under the vehicle. Also, a larger arc or a combination of connected arcs can be used to cover the entire underside of a vehicle instead of just a single arc covering the occupant compartment in the present invention. Similarly, the present invention could be placed at a different location on a vehicle than directly under the occupant compartment.

Furthermore, sensors may be added to the enclosure or near the reactive blocks of the present invention to detect lands mines or improvised explosive devices near the vehicle. This improvement to the present invention would be beneficial in situations where the vehicle is left unattended for a period of time, allowing a person to set up a land mine or improvised explosive device near the vehicle.

An additional modification to the present invention could be a higher packing density of reactive blocks. This can be achieved by inverting half of the reactive blocks and alternating non-inverted and inverted reactive blocks within the reactive block enclosure. The inverted blocks use the same principle as the non-inverted blocks but have a slightly different geometry. This embodiment will not alter the direction of the reactive explosions in the second layer of pyramids because the explosive force will act equally in all directions.

Still another embodiment of the present invention includes applying multiple apparatus in series or in spaced apart relation for protecting an extended region of the vehicle. The arc span extends across the region to be principally protected; multiple arcs or extended arc span for a given arc member extends the protected region of the vehicle.

The above mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the following claims.

What is claimed is:

1. An apparatus for use in a protective system for shielding vehicle occupants from explosive devices comprising:

an arc member having a contoured surface;

a membrane justaposed below the arc member contoured surface;

reactive blocks comprising a multiplicity of single reactive blocks formed from stacked pyramids constructed and configured outside the membrane away from the arc member;

and an enclosure for covering the reactive blocks; wherein the system is attachable to a vehicle surface; and wherein the apparatus comprises explosive material that is functional to automatically detect, and then neutralize and counteract an initial shockwave from an external explosive force by shielding and deflecting the explosive force away from the arc member, thereby providing a protective system to protect passengers in the vehicle.

2. The apparatus of claim 1, wherein the apparatus is operable to actively and passively protect the vehicle occupants from the external explosive force.

3. The apparatus of claim 1, wherein the arc member is a unitary, integral element.

4. The apparatus of claim 1, wherein the arc member provides a seamless contoured surface.

5. The apparatus of claim 1, wherein the arc member includes an arc that provides a concave surface for deflecting the external explosive force away from the vehicle occupants.

6. The apparatus of claim 1, wherein the arc member is formed from a ceramic material.

7. The apparatus of claim 1, wherein the reactive blocks further comprise a multiplicity of single reactive blocks formed from stacked pyramids.

8. The apparatus of claim 7, wherein the pyramids are inverted.

9. The apparatus of claim 1, wherein the reactive blocks include a PBX explosive material.

10. The apparatus of claim 1, wherein the membrane includes a viscoelastic material.

11. The apparatus of claim 1, wherein the enclosure fully encases all other components.

12. The apparatus of claim 1, wherein the arc member has an arc that substantially spans the distance being protected.

13. A protective system for shielding vehicle occupants from explosive forces outside the vehicle comprising:

a vehicle having an underside surface to which the apparatus of claim 1 is mounted, wherein the arc member is attached with the contoured surface facing downwardly; the system further comprising a pressure sensor, wherein the pressure sensor can detect pressure waves from an explosion and detonate the reactive blocks in response;

thereby providing a protective system for shielding and deflecting an explosive force away from the arc member to protect passengers in a vehicle.

14. The system of claim 13, wherein more than one apparatus of claim 1 is mounted to the underside of the vehicle for protecting an extended region.

15. A method for shielding vehicle occupants from explosive devices comprising the steps of:

providing the apparatus of claim 1;

mounting the apparatus to the underside of a vehicle; such that the arc member having a contoured surface is positioned downward for deflecting explosive forces and materials away from the passengers of the vehicle.

16. The method of claim 15, further including the step of automatically activating the reactive blocks by an external explosive force such that the external explosive force is redirected away from the vehicle occupants.

17. The apparatus of claim 1, further comprising a pressure sensor, wherein the pressure sensor can detect pressure waves from an explosion and detonate the reactive blocks in response.

* * * * *